US007922560B2

(12) United States Patent
Avalos-Dessner et al.

(10) Patent No.: US 7,922,560 B2
(45) Date of Patent: Apr. 12, 2011

(54) BRASSIERE CUP AND BRASSIERE FOR WOMEN HAVING UNEVENLY SIZED BREASTS

(75) Inventors: Roxana Avalos-Dessner, Dobbs Ferry, NY (US); Priscilla Acevedo, Brooklyn, NY (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 434 days.

(21) Appl. No.: 12/057,948

(22) Filed: Mar. 28, 2008

(65) Prior Publication Data

US 2009/0247047 A1 Oct. 1, 2009

(51) Int. Cl.
*A41C 3/10* (2006.01)
*A41C 3/14* (2006.01)

(52) U.S. Cl. ..... 450/39; 450/57; 450/52; 450/53; 2/267

(58) Field of Classification Search ..... 450/39, 450/55, 56, 53, 54, 57, 47, 51, 52; 2/267, 2/268, 251, 255
See application file for complete search history.

(56) References Cited

U.S. PATENT DOCUMENTS

| | | | | |
|---|---|---|---|---|
| 2,041,066 | A * | 5/1936 | Howard | 450/56 |
| 2,342,076 | A * | 2/1944 | Herbener | 450/56 |
| 2,495,307 | A | 1/1950 | Abramson | |
| 2,824,563 | A | 2/1958 | Hill | |
| 2,915,067 | A | 12/1959 | Bracht | |
| 3,384,091 | A * | 5/1968 | Block | 450/54 |
| 3,814,107 | A * | 6/1974 | Greenblatt et al. | 450/56 |
| 3,834,397 | A * | 9/1974 | Birch | 450/56 |
| 4,172,002 | A | 10/1979 | Gluckin | |
| 4,372,321 | A | 2/1983 | Robinson | |
| 4,740,258 | A | 4/1988 | Breitscheidel | |
| 4,867,826 | A | 9/1989 | Wayte | |
| 5,066,302 | A | 11/1991 | Rice | |
| 5,967,877 | A | 10/1999 | Howard | |
| 6,346,028 | B1 * | 2/2002 | Fildan et al. | 450/41 |
| 6,425,800 | B1 | 7/2002 | Huang | |
| 6,439,960 | B1 | 8/2002 | Fildan et al. | |
| 6,811,464 | B2 | 11/2004 | Li | |
| 6,935,921 | B1 | 8/2005 | Eudenbach et al. | |
| 6,966,815 | B2 | 11/2005 | Weinerth | |
| 7,052,360 | B2 | 5/2006 | Lau | |
| 7,244,167 | B2 * | 7/2007 | Falla | 450/54 |

(Continued)

FOREIGN PATENT DOCUMENTS

JP 2004256956 A 9/2004

OTHER PUBLICATIONS

Webpage printout: Amoena Breast Forms and Breast Prosthesis Accessories, www.metromedicalonline.com/mastectomy-products-breast-forms.html, available as of filing date.

*Primary Examiner* — Gloria Hale
(74) *Attorney, Agent, or Firm* — Womble Carlyle Sandridge & Rice, PLLC

(57) ABSTRACT

A brassiere cup, and a brassiere incorporating the brassiere cups, are provided. The brassiere cup includes an outer fabric layer, an inner fabric layer, and a first, inner layer of foam material positioned between the outer and inner fabric layers. The cup has a lower periphery, and an embossed breast support is positioned at the lower periphery inside of the cup.

18 Claims, 7 Drawing Sheets

U.S. PATENT DOCUMENTS

| | | | | |
|---|---|---|---|---|
| 7,381,113 | B2 | 6/2008 | Hori | |
| 7,413,495 | B1 * | 8/2008 | Sobah-Wilhelm | 450/58 |
| 2006/0052035 | A1 | 3/2006 | Walker | |
| 2006/0276105 | A1 | 12/2006 | Han | |
| 2007/0004315 | A1 | 1/2007 | Luk et al. | |
| 2007/0117495 | A1 | 5/2007 | Walker | |
| 2007/0298681 | A1 | 12/2007 | Liu | |
| 2008/0032598 | A1 | 2/2008 | Bentham et al. | |

* cited by examiner

BRASSIERE CUP AND BRASSIERE FOR WOMEN HAVING UNEVENLY SIZED BREASTS

FIELD OF THE INVENTION

The present invention relates to the field of women's undergarments, and particularly, to a brassiere for women having unevenly sized breasts.

BACKGROUND OF THE INVENTION

Brassieres are typically manufactured as unitary pieces having two cups, shoulder straps, and a closure that allows the brassiere to be closed at either the front or the back of the torso of the person wearing the brassiere. Conventionally, these brassieres are constructed with the two cups being of substantially identical shape and size. In actuality, the breasts of most women are not substantially the same size. Thus, a conventional brassiere with substantially identically sized cups does not properly support one of the unevenly sized breasts; that is, one cup is either too tight or too loose.

Numerous attempts have been made to address the problem of unevenly sized breasts, all of which have disadvantages. For example, some brassieres allow for the insertion and removal of pads in the cups to compensate for differences in breast sizes. Because of the way in which these pads are inserted, however, the breast is simply forced up without altering the size of the cup to allow the breast to fit correctly or comfortably therein. Other attempts to address the problem involve brassieres being constructed with elasticized cups that stretch to the extent required for each breast; however, this results in visibly different sized breasts when seen from the outside, which can be embarrassing and/or is otherwise undesirable to the wearer. Others employ straps that may be tightened or loosened to accommodate each breast. Again, this results in visibly different sized breasts when worn. Still others employ separable cups so that the wearer may purchase the appropriately sized cup for each breast and assemble the cups to form the brassiere; however, the difference in the sizes of the cups is again noticeable. Thus, what is needed is a brassiere that can accommodate unevenly sized breasts that does not have the disadvantages of known solutions to the problem.

Various features and aspects of the invention will become apparent upon review of the detailed description set forth below when taken in conjunction with the accompanying drawings, which are briefly described as follows.

DETAILED DESCRIPTION OF THE PREFERRED EMBODIMENTS

Certain exemplary embodiments of the present invention are described below and illustrated in the accompanying figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art, and all such alternate embodiments, modifications, and improvements are within the scope of the present invention.

Figure 1:
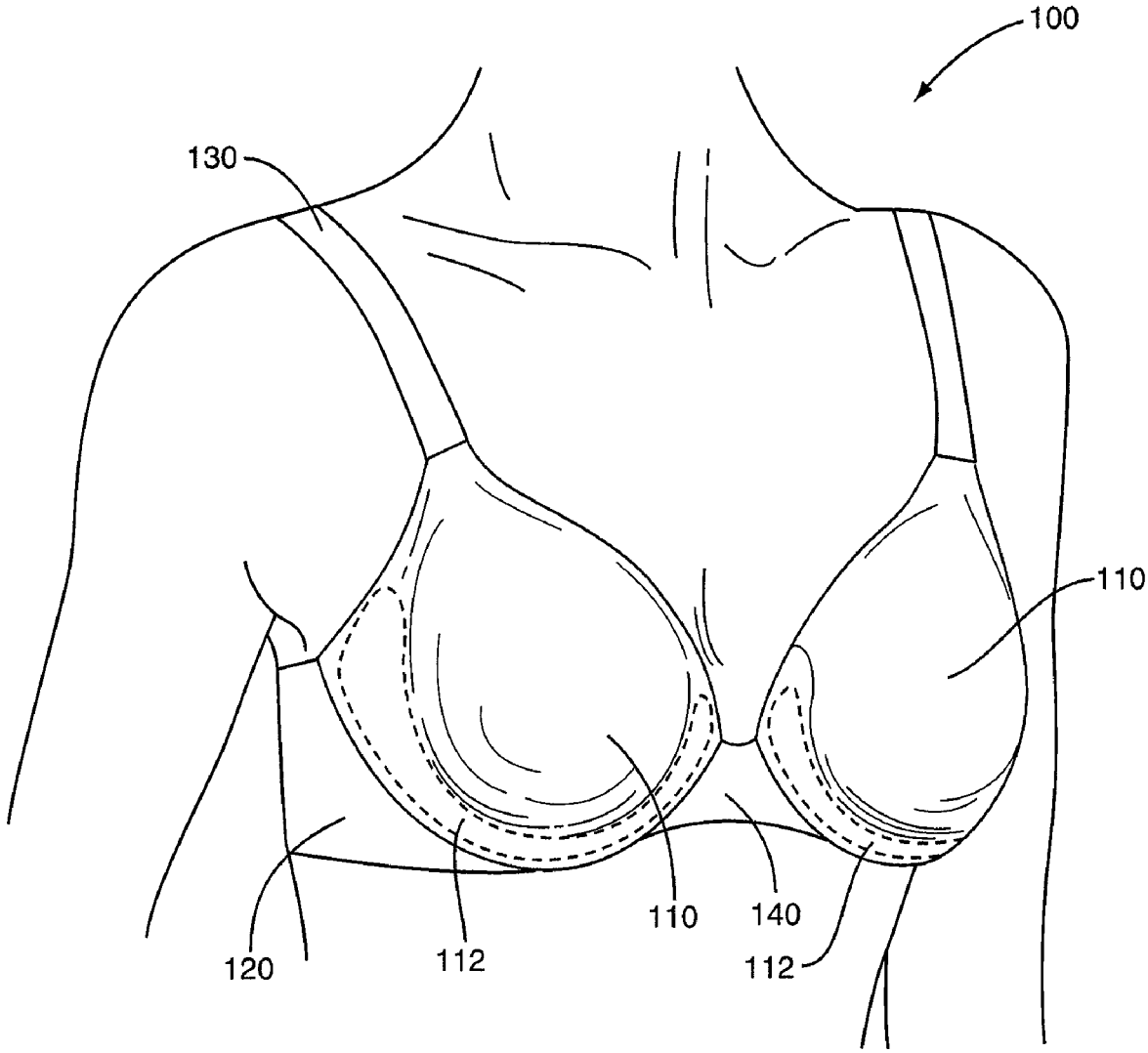
FIG. 1 is a front perspective view of a brassiere constructed according to the present invention.

Referring to the Figures in general, and FIG. 1 in particular, the present invention is directed to a brassiere cup, or breast receiving cup, construction, and a brassiere, shown generally as 100. The brassiere incorporates the breast receiving cups 110, described in detail herein. As is conventional, the brassiere 100 comprises two breast receiving cups 110, to which are attached to body, or side, straps 120. Formed inside and along the lower periphery of each breast receiving cup 110 is a breast support 112. Optional shoulder straps 130 are provided, as necessary, to support the breast receiving cups 110, depending upon the particular style and size of the breast receiving cups 110. A rear closure (not shown), such as a hook-and-eye configuration, may be provided at the terminal ends of the body straps 120. The straps also may be permanently joined or formed as a single piece for fitting snugly about the torso of the wearer. Alternatively, it is contemplated that the breast receiving cups 110 may be joined at the bridge with a front closure. Additionally, certain embodiments of the brassiere may also include underwires at the lower periphery of each cup, or alternatively the brassieres may be constructed with semi-rigid or rigid frames about each of the breast receiving cups.

The two breast receiving cups 110 are a mirror image about the bridge, or intermediate portion 140. While the description that follows is to a single breast receiving cup 110, it will be appreciated that the detail applies to both breast receiving cups of the brassiere 100.

Figure 2:
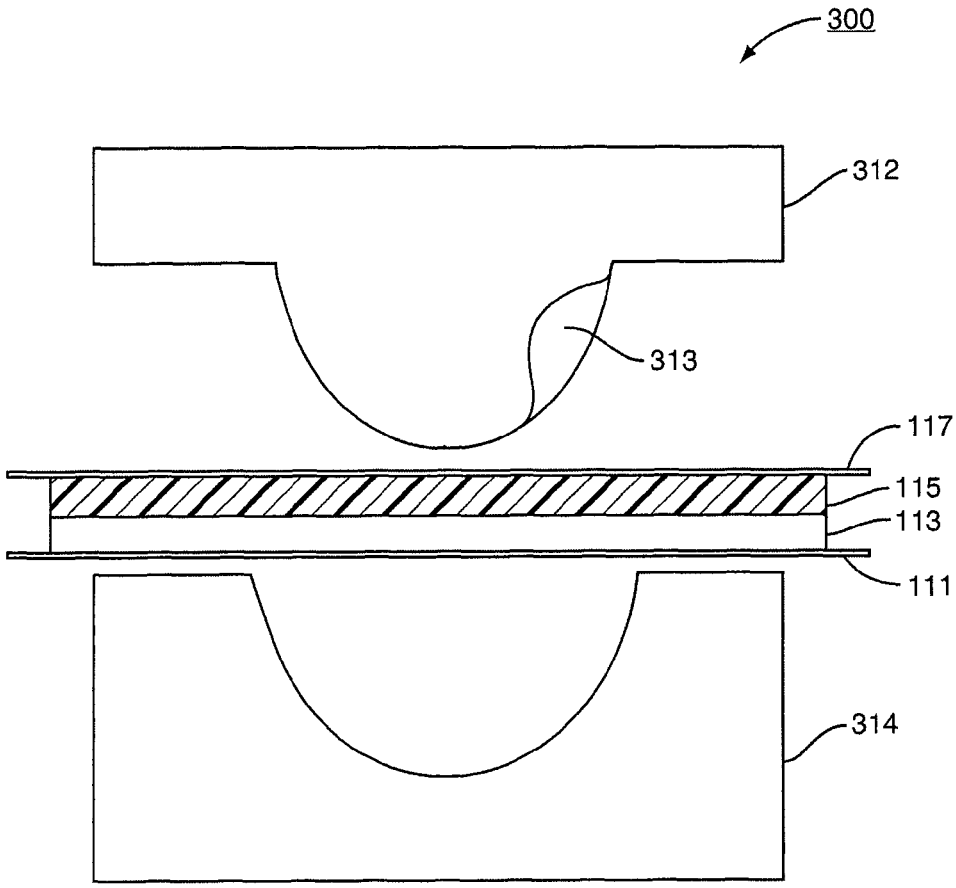
FIG. 2 is an elevational view of the multi-layer breast receiving cup construction of the present invention prior to being molded.
Figure 3:
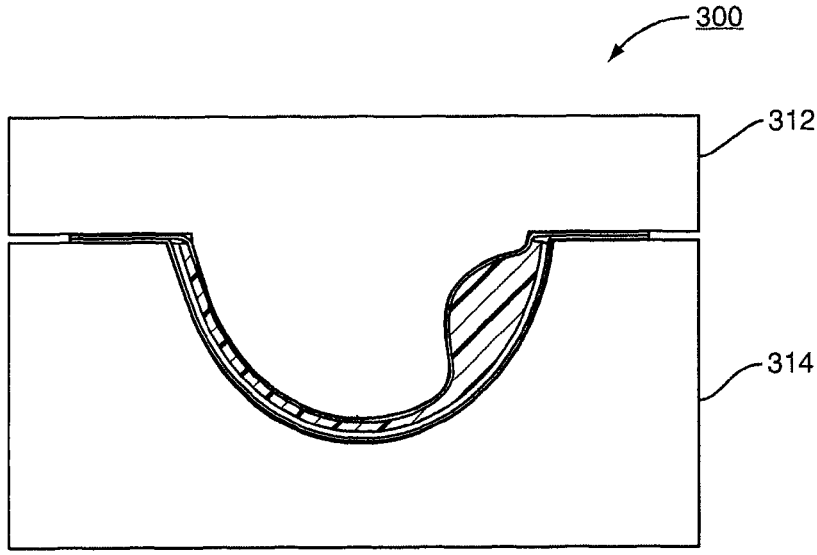
FIG. 3 is an elevational view of the mold forming the breast receiving cup of the present invention.
Figure 4:
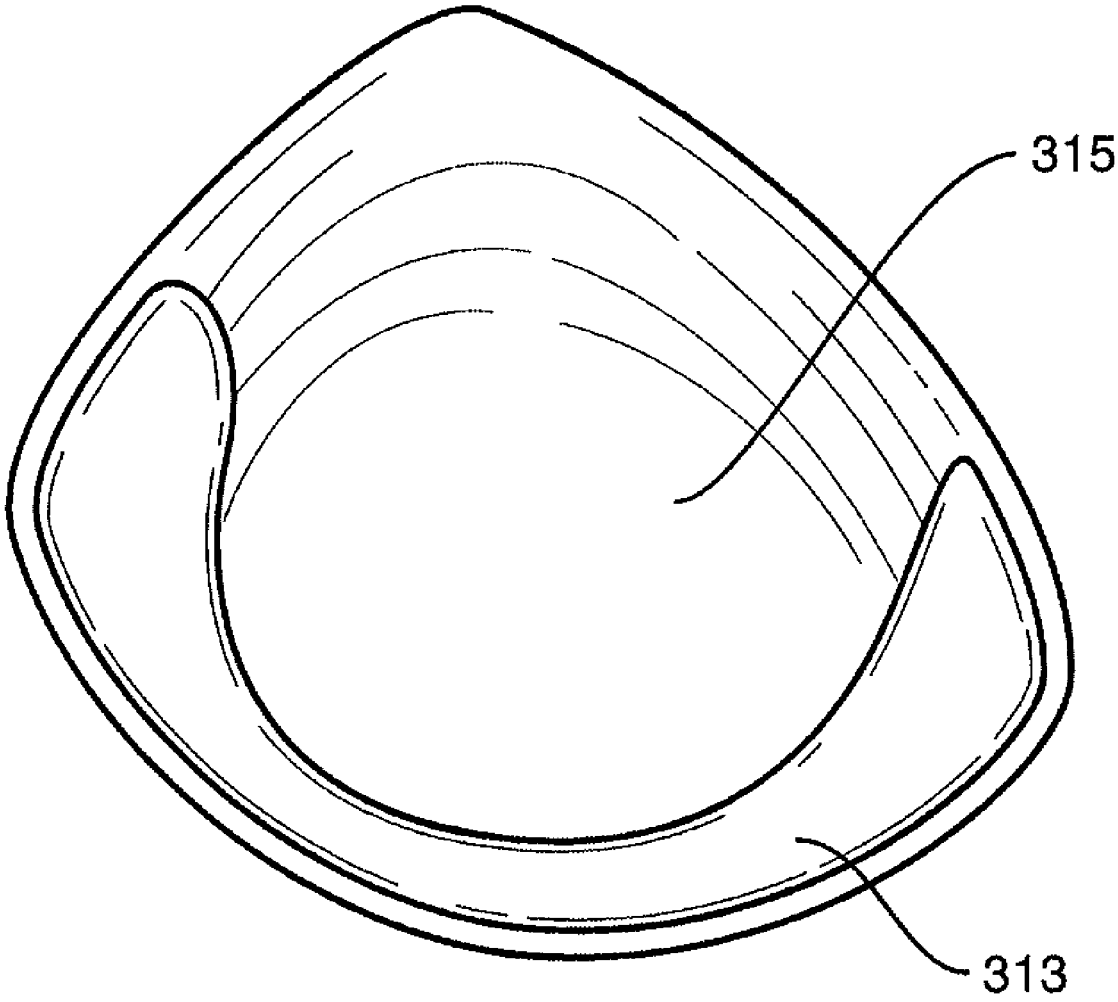
FIG. 4 is a bottom view of the convex portion of the mold for forming the breast receiving cup of the present invention.

Turning now to FIGS. 2 through 4, the process for forming the breast receiving cup 110 of the present invention is illustrated. As shown in FIGS. 2 and 3, the breast receiving cup 110 is molded into a three-dimensional cup-shaped form from sheet materials. As shown in FIG. 2, each of the planar layers of the construction comprise an initial uniform thickness. In the embodiment shown, the breast receiving cup 110 is formed from a multi-layer laminated assembly. As will be appreciated, two or more of the layers may be bonded together or pre-laminated in advance of the molding process as manufacturing parameters dictate. In the embodiment shown, the breast receiving cup 110 comprises a first outer fabric layer 111, a first flexible foam layer 113, a second flexible foam layer 115, and a second inner fabric layer 117; however, it is envisioned that the breast receiving cup 110 may comprise only a single layer of flexible foam 115, and the outer and inner fabric layers 111, 117 also may be optional, depending upon the intended use of the brassiere 100; i.e., depending upon whether the brassiere is intended for athletic, casual, or formal wear. Accordingly, the outer and inner fabric layers 111, 117 may be formed from any suitable fabric including, for example, polyester, cotton, spandex, nylon, or intimate blends thereof. In the embodiments described herein, the outer and inner fabric layers 111, 117 are knitted.

In the embodiment shown in FIG. 2, the first flexible foam layer 113 is selected to provide for a stable and semi-rigid breast-enhancing shape for the breast receiving cup 110; however, this foam layer 113 may not be necessary in certain embodiments. In this regard, the first flexible foam layer is more dense foam than the second flexible foam layer 115. As will be understood, the thickness of the second flexible foam layer 115 is selected based upon the desired thickness of the breast support 112 on the inside of each breast receiving cup 110. The second flexible foam layer 115 is selected as a less dense, and hence softer, foam, which is more comfortable to the wearer since it is the layer of foam that is closest to the wearer's breast. While numerous foam-like materials may be used to create the breast receiving cup 110 described herein, the foam material used in the flexible foam layers 113, 115 of the brassiere 100 is typically polyurethane, polyethylene, vinyl foam, and combinations thereof. As will be appreciated, the particular materials selected must be suitable for adhesive bonding and able to withstand the heat of the molding process, without adversely affecting the material properties.

Turning now to FIGS. 3 and 4, the process for forming the three-dimensional breast receiving cup 110 is illustrated. The multi-layered assembly is laminated in a molding device such as, for example, the device 300 shown in the Figures, comprising two mold portions, wherein the upper mold portion 312 comprises a convex-shaped relief, and the lower mold portion 314 comprises a concave-shaped relief. The two mold portions have complementary geometries. To produce the three-dimensional breast receiving cup 110, the assembly of layers 111, 113, 115, and 117 are positioned intermediate the mold portions 312 and 314 so that they overlay one another. The two mold portions 312, 314, which are preferably heated, as known in the art, are then brought together under pressure to compress and laminate the multiple layers. As will be appreciated, an adhesive may also be applied between the layers to ensure a suitable laminated bonding of the layers.

As best shown in FIGS. 3 and 4, the convex portion 312 comprises a cut-out 313, which is dimensioned to the desired geometry of the breast support 112. FIG. 4, which is a bottom view of the convex mold portion 312, is illustrative of one cut-out 313 geometry. Thus, when the mold portions 312, 314 are brought together, the layers lying outside of the cut-out 313 region, in the area shown as 315, are substantially more compressed, whereas the layers beneath the cut-out 313 are less compressed, but still compressed to the extent necessary to laminate the layers 111, 113, 115, and 117 together. The result is a raised, or embossed, breast support 112, formed on the inside, lower periphery, of the molded breast receiving cup 110.

Figure 5:
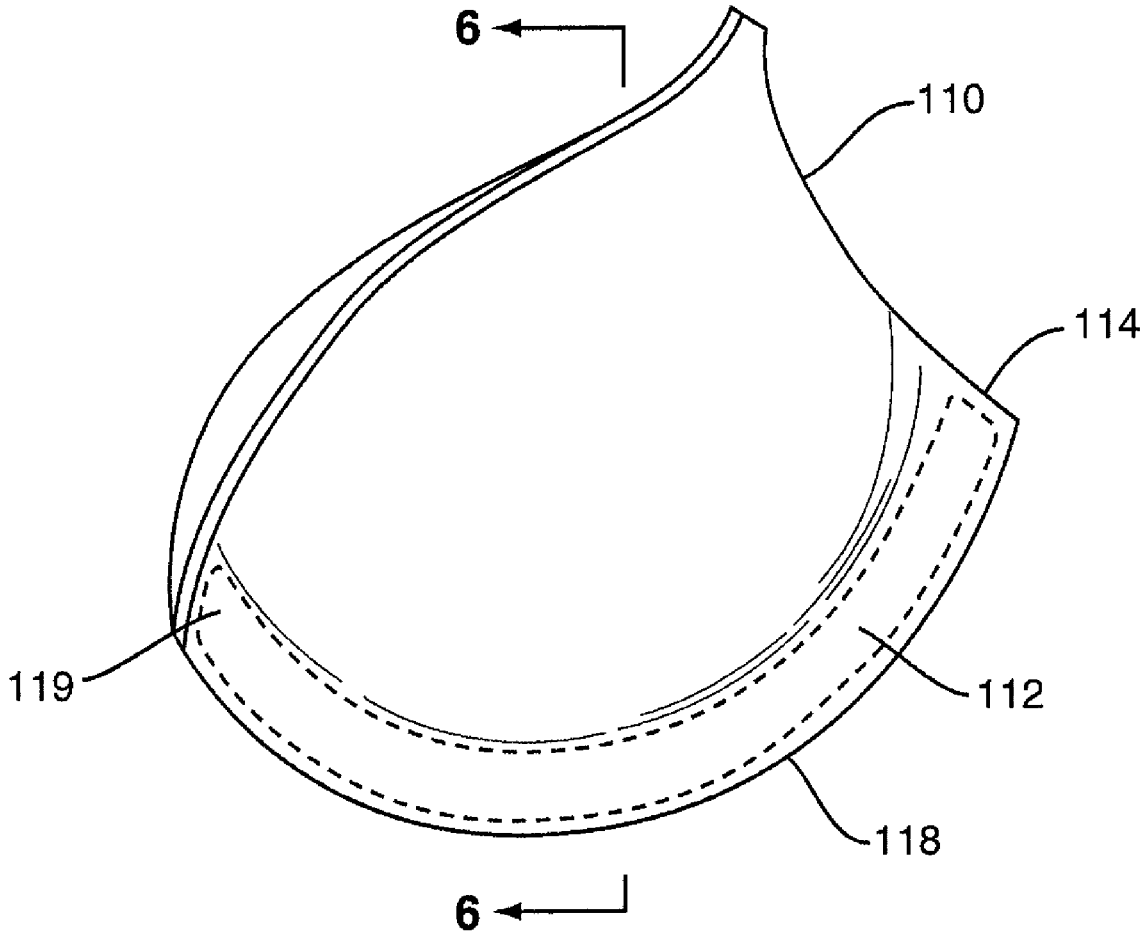
FIG. 5 is a rear perspective view of a breast receiving cup according to one embodiment of the present invention.
Figure 6:
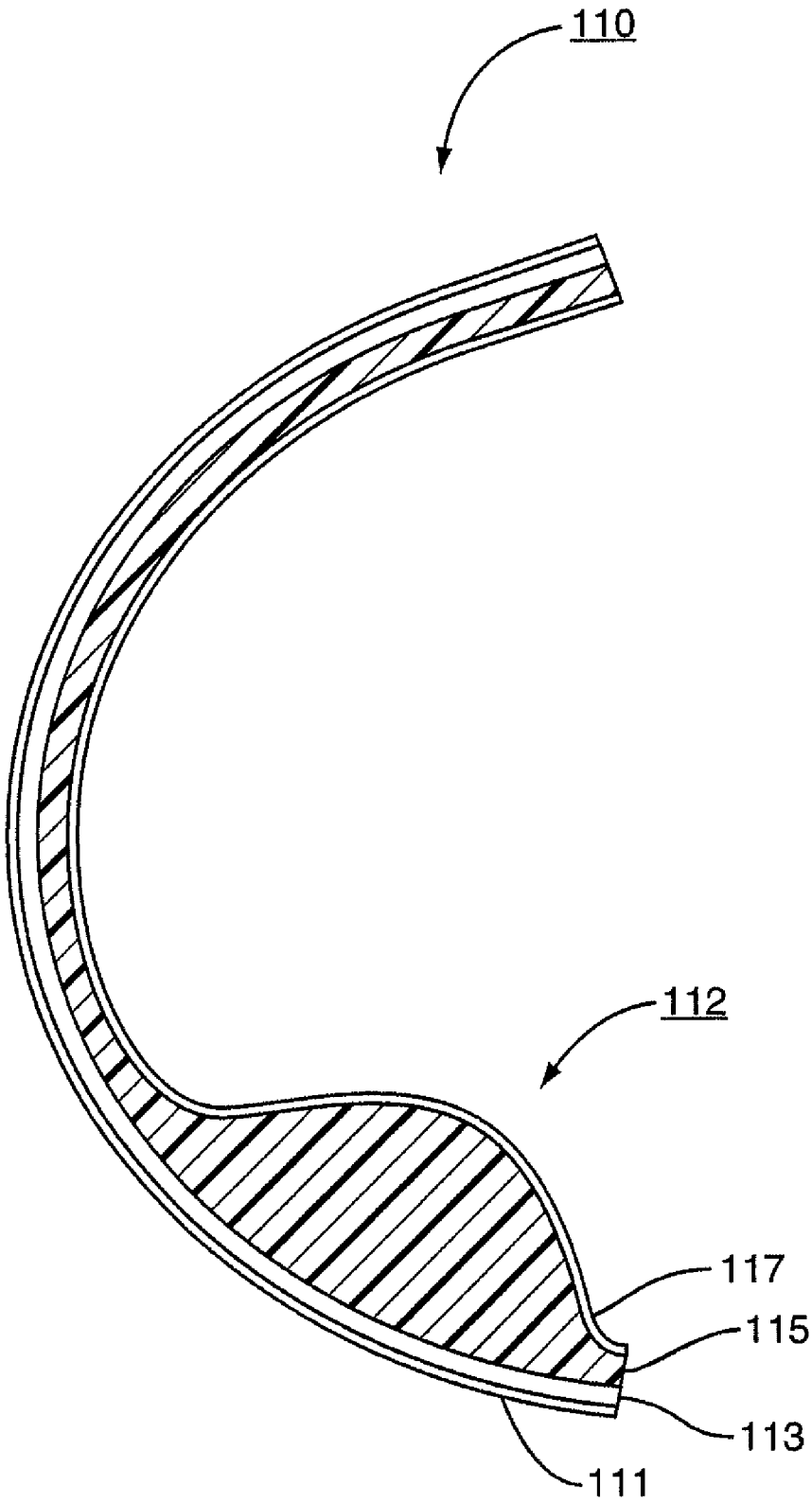
FIG. 6 is a cross-sectional view of the breast receiving cup of FIG. 5 taken along Line 6-6.

Turning now to FIGS. 5 and 6, the formed breast support 112 is slightly spaced apart from the lower peripheral edge 118 of the molded breast receiving cup 110, wherein the edge 118 is more compressed. As will be appreciated, this is desirable from both aesthetic and comfort aspects so that the breast receiving cup 110 tapers down to the wearer's torso surrounding the breast. Additionally, the compressed edge 118 facilitates the attachment of side straps 120 to each breast receiving cup 110.

With reference to FIG. 5, the functionality of the molded breast receiving cup 110 with breast support 112 is best illustrated. As shown, the breast support 112 is generally U-shaped and extends along the lower periphery of the breast receiving cup 110, and as will be appreciated, also extends from the underarm region 114 on one side of the breast receiving cup 110 to the intermediate, or bridge, region 119 on the opposite side of the breast receiving cup 110.

Turning to FIG. 6, the breast receiving cup 110 and breast support 112 are shown in cross-sectional view. As shown in the Figure, the compressed flexible first foam layer 113 and outer fabric layer 111 create a constant breast-enhancing shape and provide rigidity for the breast receiving cup 110. Whereas the prior art brassiere cups were adjustable in size and shape, the breast receiving cups 110 of the present invention are similarly shaped when viewed from the outside, yet provide the requisite cradling and/or support on the inside, even when the breasts of the wearer are unevenly sized.

Figure 7A:
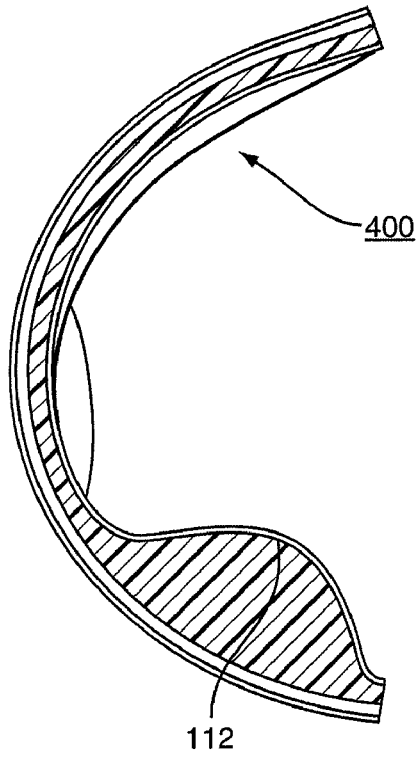
FIG. 7A is a cross-sectional view of the breast receiving cup, illustrating the functionality of the breast receiving cup with a smaller breast.

Turning to FIG. 7A, when the brassiere 100 is properly fitted for the wearer, the breast support 112 provides a "cradle" so that the smaller breast 400 will not sag or hang downwardly. Thus, the second foam layer 115 and inner fabric layer 117 of the breast support 112, which forms the soft cushioning for the breast support 112, is still sufficiently supportive to hold the smaller breast 400 higher in the breast receiving cup 110, yet is compressed very little by the weight and shape of the breast.

Figure 7B:
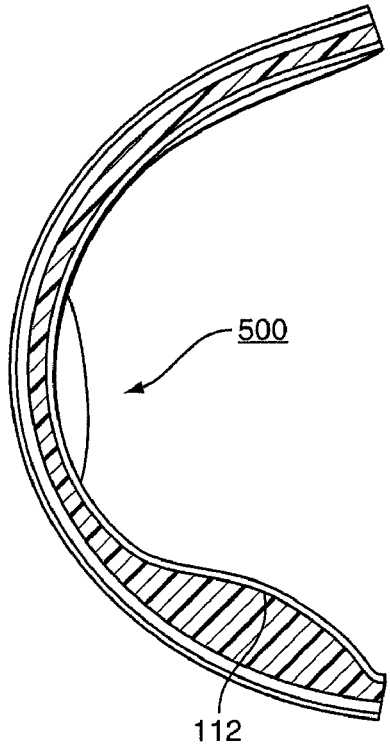
FIG. 7B is a cross-sectional view of the breast receiving cup, illustrating the functionality of the breast receiving cup with a larger breast.

Turning to FIG. 7B, in the case of the larger breast 500, the breast support 112 enables the breast 500 to fill out the cup while still being supported on the soft breast support 112. Because of the softness and compressibility of the breast support 112, the breast support 112 may compress as necessary to accommodate the larger breast 500. This structure also solves another problem encountered by women with unevenly sized breasts when wearing conventional brassieres. In particular, with conventional brassieres, the unevenness in breast size causes an imbalance when the brassiere is worn, wherein the smaller breast, when not properly cradled and supported, sags downwardly. The weight of the smaller breast causes the larger breast to bulge upwardly at the neckline region of the brassiere. This is both uncomfortable and visually unattractive. The breast support 112 of the present invention, however, forces a balance between the two breast receiving cups 110, eliminating or reducing this condition.

Figure 8:
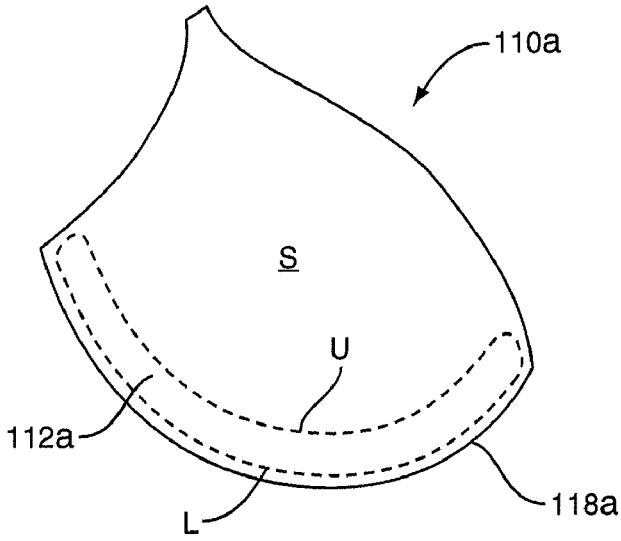
FIG. 8 is a rear view of one embodiment of the breast receiving cup of the present invention.
Figure 9:
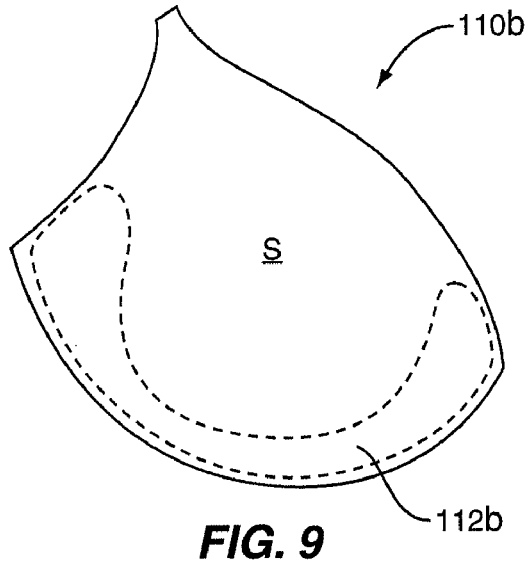
FIG. 9 is a rear view of an alternative embodiment of the breast receiving cup of the present invention.
Figure 10:
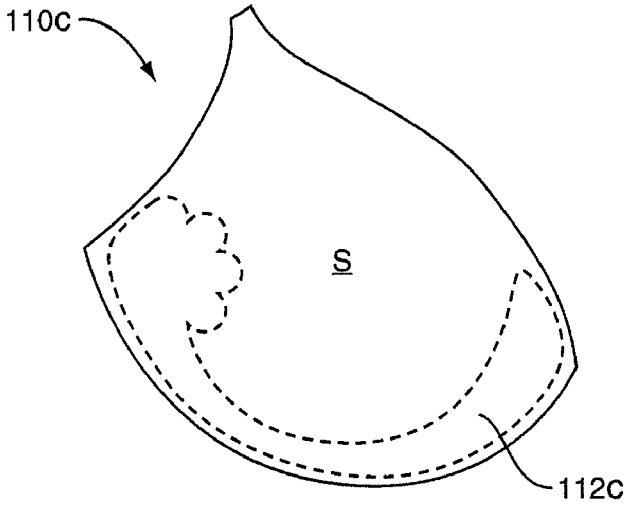
FIG. 10 is a rear view of another alternative embodiment of the breast receiving cup of the present invention.

Turning lastly to FIGS. 8 through 10, three exemplary embodiments of the breast support 112 and breast receiving cup 110 are shown. As shown in FIG. 8, in one embodiment the breast support 112*a* is generally U-shaped, having upper 'U' and lower 'L' edges that are substantially parallel with each other and parallel to the lower peripheral edge 118*a* of the breast receiving cup 110*a*. The opposed ends of the breast support 112*a* are rounded to provide a smooth transition from the breast support 112*a* to the inner surface 'S' of the breast receiving cup 110*a*. As shown in FIG. 9, in another embodiment, the breast support 112*b* comprises opposed ends that taper to a width greater than the width of the structure therebetween. This breast support 112*b* structure is desirable when more cradling and/or support is desired in the underarm and bridge regions. Alternatively, only of the opposed ends may be tapered to a greater width. In either case, the thickness of the breast support is constant along its entire length. In yet another embodiment, shown in FIG. 10, one of the opposed ends of the breast support 112*c* comprises an ornamental shape, such as that of a flower; however, the raised molded ornamental design still performs the same function of cradling and/or supporting of the breast and is of the same thickness as the remainder of the breast support 112*c*.

Although the present invention has been described with an exemplary embodiment, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. A brassiere cup, comprising:

(a) an outer fabric layer, an inner fabric layer, and a first, inner continuous layer of flexible foam material positioned between the outer and inner fabric layers, the cup having a lower periphery; and (b) the outer fabric layer, inner fabric layer, and inner continuous layer of flexible foam molded to form a cup with a breast support having a convex-shaped cross-section, the breast support projecting inwardly and extending along the lower periphery inside of the cup.

2. The brassiere cup of claim 1, further comprising a second, outer layer of foam material positioned between the first, inner layer of foam material and the outer fabric layer.

3. The brassiere cup of claim 2, wherein the first, inner layer of foam has a density less than the density of the second, outer layer of foam.

4. The brassiere cup of claim 2, wherein the inner layer of foam material is selected from the group consisting of polyurethane, polyethylene, vinyl foam, and combinations thereof.

5. The brassiere cup of claim 1, wherein the embossed breast support is substantially U-shaped.

6. The brassiere cup of claim 5, wherein the cup-shaped structure further comprises an underarm area and a bridge area, and wherein the breast support has opposed ends, one of the opposed ends terminating at the underarm area and the other terminating at the bridge area.

7. The brassiere cup of claim 6 wherein the opposed ends of the breast support are rounded.

8. The brassiere cup of claim 6, wherein the opposed ends taper to a width that is greater than the width of the breast support therebetween.

9. A brassiere, comprising:

(a) a pair of similarly sized breast receiving cups, each cup comprising:

(i) an outer fabric layer, an inner fabric layer, and a first, inner continuous layer of flexible foam material positioned between the outer and inner fabric layers, the cup having a lower periphery;

(ii) the outer fabric layer, inner fabric layer, and inner continuous layer of flexible foam molded to form a cup with a breast support having a convex-shaped cross-section, the breast support projecting inwardly and extending along the lower periphery inside of the cup; and (b) a body strap attached to each of the breast receiving cups.

10. The brassiere of claim 9, further comprising a second, outer layer of foam material positioned between the first, inner layer of foam material and the outer fabric layer.

11. The brassiere of claim 10, wherein the first, inner layer of foam has a density less than the density of the second, outer layer of foam.

12. The brassiere of claim 10, wherein the inner layer of foam material is selected from the group consisting of polyurethane, polyethylene, vinyl foam, and combinations thereof.

13. The brassiere of claim 9, wherein the embossed breast support is substantially U-shaped.

14. The brassiere of claim 13, wherein the cup-shaped structure further comprises an underarm area and a bridge area, and wherein the breast support has opposed ends, one of the opposed ends terminating at the underarm area and the other terminating at the bridge area.

15. The brassiere of claim 14 wherein the opposed ends of the raised breast support are rounded.

16. The brassiere of claim 14, wherein the opposed ends taper to a width that is greater than the width of the breast support therebetween.

17. The brassiere of claim 9, further comprising a pair of shoulder straps.

18. A method of forming a brassiere cup to accommodate unevenly sized breasts, comprising:

(a) providing a two-part mold assembly comprising a concave mold portion and a convex mold portion, the convex mold portion dimensioned for mating engagement with the concave mold portion and having a cutout with a concave-shaped cross-section;

(b) placing a multi-layer assembly comprising an outer fabric layer, an inner fabric layer, and a first, inner continuous layer of flexible foam between the convex mold portion and a concave mold portion;

(c) moving one of the convex and concave mold portions so that the mold portions mate; and (d) compressing the multi-layer assembly to form a cup-shaped laminated brassiere cup with a breast support having a convex-shaped cross-section, the breast support projecting inwardly and extending along the lower periphery inside of the cup.

* * * * *